United States Patent [19]

Bartoli

[11] Patent Number: 5,000,447

[45] Date of Patent: Mar. 19, 1991

[54] DEFORMABLE BASE

[76] Inventor: Ronald W. Bartoli, 660 Green Acre Dr., Fullerton, Calif. 92635

[21] Appl. No.: 324,660

[22] Filed: Mar. 17, 1989

[51] Int. Cl.[5] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 1,244,044 | 10/1917 | Falconer | 273/25 |
| 2,046,126 | 6/1936 | Latina | 273/25 |
| 2,103,148 | 12/1937 | Conrad | 273/25 |
| 2,275,547 | 3/1942 | Mouch | 273/25 |
| 2,405,492 | 8/1946 | Corbett | 273/25 |
| 2,624,580 | 1/1953 | Corbett | 273/25 |
| 2,756,999 | 7/1956 | Orsatti | 273/25 |
| 3,466,039 | 9/1969 | Golomb | 273/25 |
| 3,703,285 | 11/1972 | Perry | 273/25 |
| 3,743,289 | 7/1973 | Golomb | 273/25 |
| 3,971,558 | 7/1976 | Gardetto | 273/25 |
| 4,405,130 | 9/1983 | Mullany | 273/25 |
| 4,448,414 | 5/1984 | Gutierrez | 273/25 |
| 4,529,199 | 7/1985 | Fatool | 273/25 |
| 4,542,901 | 9/1985 | Fatool et al. | 273/25 |
| 4,723,779 | 2/1988 | Hauser | 273/25 |
| 4,744,561 | 5/1988 | Hall | 273/25 |

FOREIGN PATENT DOCUMENTS

| | | | |
|---|---|---|---|
| 943569 | 3/1974 | Canada | 273/25 |

*Primary Examiner*—Theatrice Brown

*Attorney, Agent, or Firm*—Foley & Lardner, Schwartz, Jeffery, Schwaab, Mack, Blumenthal & Evans

[57] ABSTRACT

In an energy absorbing base for a baseball field, a molded rubber base includes a hollow underside. Ribs arranged in a chevron-like pattern are positioned within this hollow underside, to absorb the impact energy of a player sliding into the base. The ribs are configured so that the edges of the flexing base deflect downwardly as the impact energy is absorbed. The energy absorbing capacity of the base is a function of both the material of which it is made and the dimensions of the ribs.

18 Claims, 2 Drawing Sheets

DEFORMABLE BASE

BACKGROUND OF THE INVENTION

The invention relates to a base for playing baseball or softball. The bases presently in use can be hazardous to a player, who must touch or step on every base in proceeding around the baseball diamond. For the base runner to avoid tripping or stumbling, the base must be firm when touched or stepped upon Base runners, however, must often slide into a base, rather than run over it or touch it. Sliding can be especially dangerous. The edge of the base might flex or turn upwardly and, thereby, catch or snag a runner's leg or arm. Nor do the anchored bases in common use today absorb the impact of the sliding player.

One typical solution is the use of shearable or breakaway bases, such as that shown in U.S. Pat. No. 4,398,715, to Hall. The tops of these and similar bases are detachably secured to a ground plate or equivalent holding device. The momentum of the sliding player shears or breaks away the detachable upper portion of the base from the fixed ground plate.

The ground plate for a breakaway base, however, needs Velcro pads, snap fasteners or the like for holding the detachable upper portion in place. The anchored portion remains in place in the base path even after play is concluded. Therefore, it is exposed to damage from weather, or to vandalism when the playing field is not in use. Also, the breakaway portion of a base must be re-attached each time a player slides into it. In addition, an umpire will find it difficult to render rulings ("out" or "safe") when the base itself moves.

A base should, for these reasons, be rigid enough to be run over or stepped on without deforming and, at the same time, resilient enough to deform and absorb the impact of a player sliding into it. This impact absorbing capability is especially important in protecting younger, lighter weight players, who might be injured by sliding into a base that does not adequately flex or deform.

SUMMARY OF THE INVENTION

The invention is a uniquely constructed base that minimizes the possibility of injury whether stepped upon or slid into. The base is anchored or fixed in position for play by a post attached to the center of the base and extending into a retaining sleeve buried in the ground (base path). The base itself, with the post attached, may be removed after the conclusion of play, for safe keeping or use elsewhere, but the anchoring sleeve remains in place The top face of the base is contoured to slope downwardly at its edges. Because of this construction, a player will ordinarily slide up and over the base without catching an arm or leg underneath it. The top or upper face of the base may be provided with traction-improving grooves or ridges to assist base runners. The base is also rigid enough to withstand being stepped upon or run over without deforming.

The base is hollow on its underside (the side adjacent to the ground), except for an arrangement of specially designed ribs. The base, including the ribs, is made of a selected rubber or similar deformable material.

The impact of a sliding player is absorbed by the deforming or flexing of the ribs. The design of the ribs, in addition, causes the edges of the base to deform downwardly upon impact and, thereby, further reduce or eliminate the possibility that the sliding player will catch a limb under the base. The impact absorbing capacity of the base may be increased by packing the spaces between the ribs with a suitable impact absorbing material.

The deformability of the base may be varied by choice of the material of which it is made or the dimensions of the ribs. Childrens' or teen-agers' teams, for example, could use relatively deformable bases, to better absorb the energy of a slide. Heavier and/or more experienced players would use less yielding bases.

It is an object of the invention, therefore, to provide a deformable baseball base that, by virtue of its construction, protects players against injury.

It is a further object of the invention to provide a deformable base that absorbs and dissipates the impact of a base runner sliding into it, with the portion of the base deformed returning resiliently to its normal, at rest shape.

It is another object of the invention to provide a base having a contour that protects players, when sliding into the base, from catching a limb underneath it.

It is still another object of the invention to provide a base that may be easily affixed to, and removed from, the base path or playing field It is yet another object of the invention to provide a base in which the impact absorbing capacity may be varied to correspond to the sizes and weights of the players.

These and other objects and advantages of the invention will be understood and obvious in light of the detailed description of the invention and the accompanying drawings

DETAILED DESCRIPTION OF THE PREFERRED EMBODIMENTS

Figure 1:
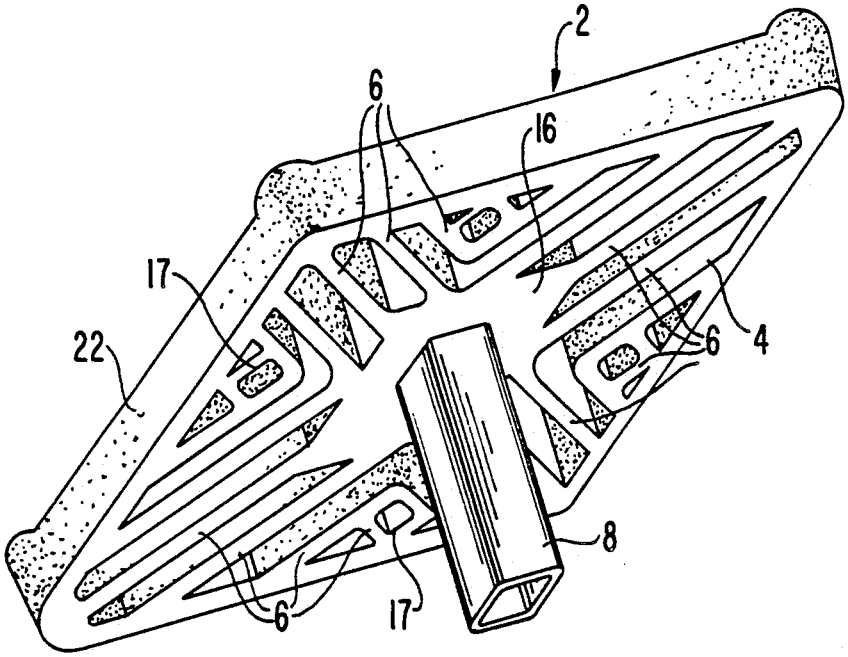
FIG. 1 is a perspective view of the deformable base constituting this invention, taken from the underside of the base.
Figure 3:
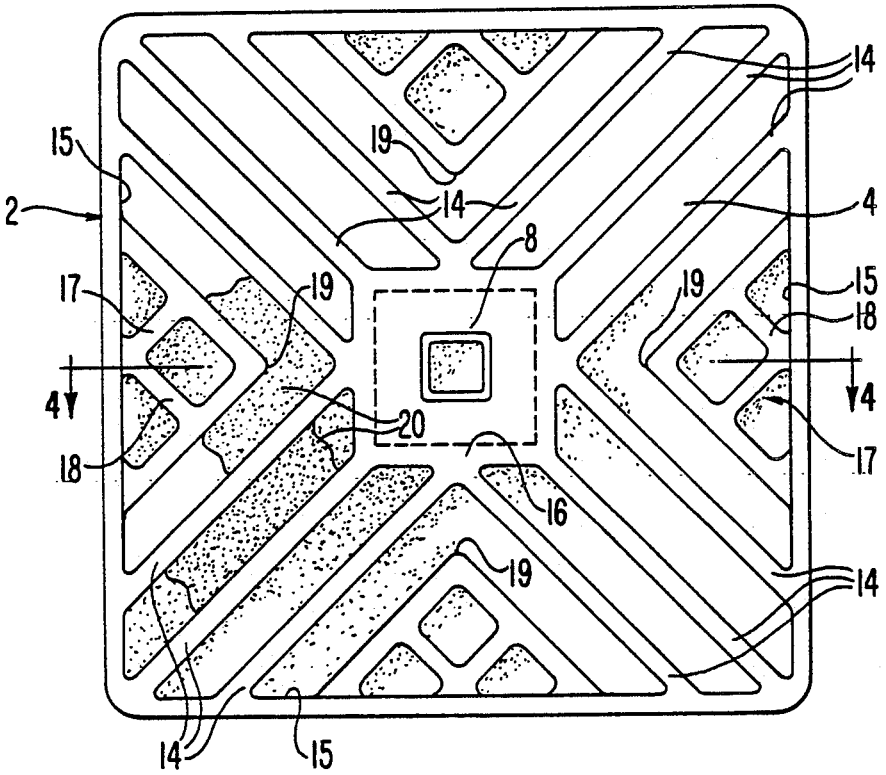
FIG. 3 is a bottom plan view of the base, illustrating its rib arrangement.
Figure 4:
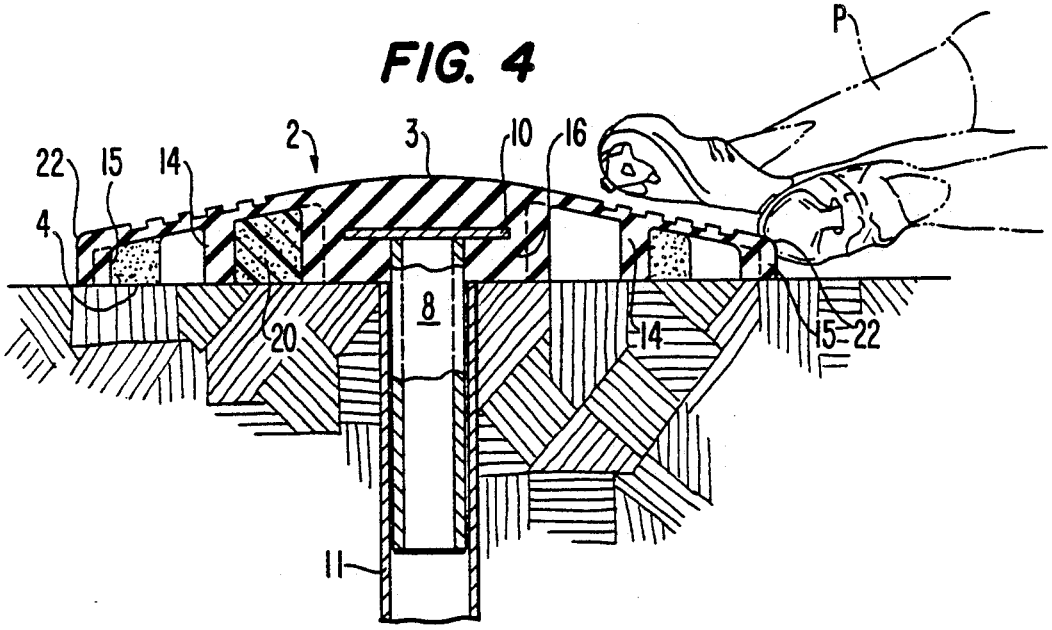
FIG. 4 is a cross-sectional view of the base, taken along line 4—4 of FIG. 3, showing the contour of the base.

As illustrated in FIGS. 1 and 4, base 2 is formed with a slightly rounded top or crown 3. The underside 4 of the base is hollow, except for an array of resiliently deformable ribs 6. One arrangement of these ribs is described in detail below in connection with the description of FIG. 3.

The base 2 is made of rubber or other resiliently deformable material of a hardness in the range of 50 to 70, as measured by a Shore durometer. The particular hardness can be selected to correspond in general to the average age and consequently the weight of the players. A more resilient (softer) base would be used by lighter weight players, and a less resilient material would be used by adult players.

In any event, the base deforms laterally inwardly upon contact, in order to avoid any sudden force or impact while sliding. After impact, the resilient nature of the base material returns the deformed portion to its original shape. This resilient rebound, so to speak, is deliberate, to avoid significant pressure or stress in the opposite direction.

A metal post 8 is rigidly attached to the underside of the base. This post is welded to a plate 10, embedded within a generally square, solid unribbed portion 16 of the base. During use, the post 8 fits into, and is anchored by, a buried retaining sleeve 11. As shown in FIG. 4, the top of sleeve 11 extends just below ground level. The post 8 and sleeve 11 are preferably non-circular in cross-section to avoid rotation of the base, reference being made to FIGS. 1 and 3.

At the conclusion of play, the base, with the post 8 attached, may be withdrawn from the retaining sleeve for storage. Since the sleeve 11 is buried, there is practically no danger of, or opportunity for, vandalism or other damage to the sleeve. The sleeve may be covered by a cap, when not in use to keep it from filling with dirt.

Figure 2:
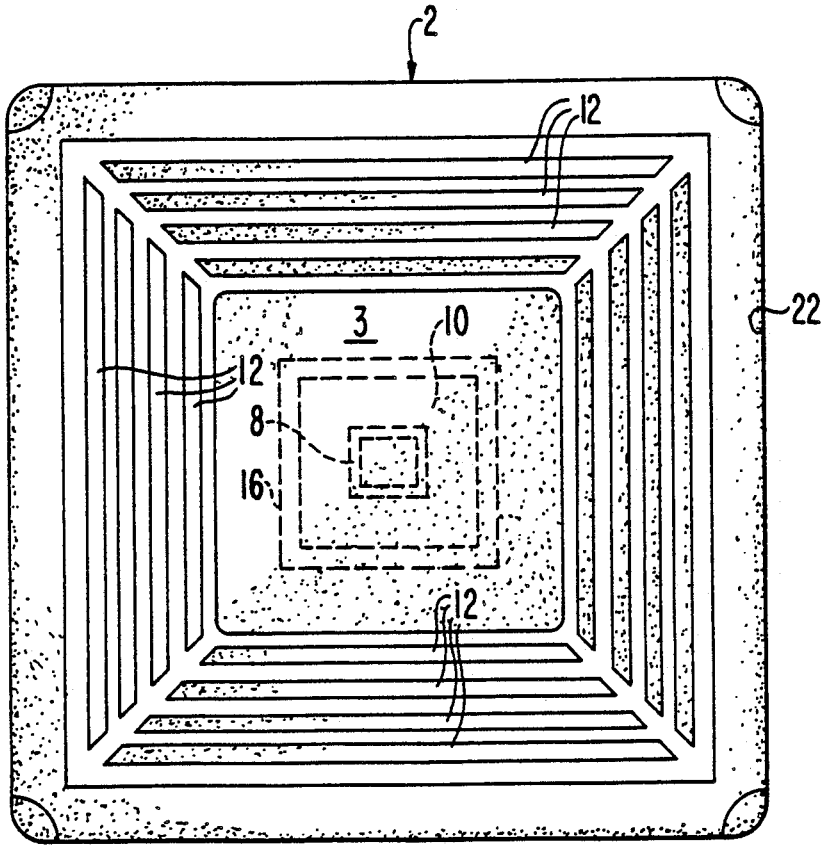
FIG. 2 is a top plan view of the base.

The square shape of the base is illustrated in FIG. 2. In this embodiment, the top face 3 of the base is formed with regularly spaced ridges 12 thereon, which provide additional traction to a base runner. This tread design is only one of a number of designs that could be used. It is not absolutely necessary, however, for any tread design to be used.

FIG. 3 illustrates the chevron-like arrangement of ribs on the underside of the base. Each of the ribs 14 extends between a point on the peripheral wall 15 of the base and the centrally positioned solid core portion 16. As clearly illustrated in FIGS. 1 and 3, some of the ribs 14 extend from locations between corners of the square base defined by peripheral wall 15. The ribs extend vertically to the bottom of the base and engage the ground when the base is in use, reference being made to FIG. 4. These sets of parallel ribs 14 are complemented by generally triangular shaped groups of ribs, including ribs 17, parallel to ribs 14, and interior ribs 18, which run perpendicularly to ribs 17. The apical connecting point 19 of the ribs 17 is spaced from the core portion 16. These groups are positioned intermediate each corner of the base. The central solid portion 16 gives the base and ribs structural rigidity, and enables the ribs to flex controllably upon lateral impact. When a player steps on the base, however, the ribs are wide and rigid enough to withstand the impact without flexure.

Regardless of the direction of the impact caused by a player sliding into the base, the ribs 14 and 17 are pushed inwardly toward the solid central portion 16. At the same time, the edges of the base flex downwardly toward the ground. There is no storage of impact energy, and no subsequent recoiling or rebounding of the base to injure the player.

Instead, the kinetic energy of the slide is effectively dissipated or dampened by the rib arrangement, as the base slowly absorbs the player's momentum. The resiliency of the ribs returns the same and the peripheral wall 15 to their original position following the slide impact This resilient return movement is a gradual, essentially constant force, unnoticeable to the player.

The base's deformation also avoids the danger of catching a hand or leg under the base. The downward flexure of the base prevents the anchor post from being lifted out of the retaining sleeve and the base from moving away from the retaining sleeve.

The amount of flexure of the base is directly related to the hardness of the rubber or other material of which it is made. Additional impact absorption can be obtained, however, by inserting in the spaces between the ribs a suitable shock absorbing material 20. In FIG. 3, two spaces are shown as filled with material 20, and one space is shown in FIG. 4. In actual use of the bases, all of the spaces between the ribs could be so filled Various open celled, expanded polymers have proven satisfactory for this purpose, including the commercially available sponge product "Ensulite." On wet playing fields, however, water may enter the open cells of material 20 and, thereby, reduce the ability of this open cell polymer to absorb a sliding impact In such a case, closed cell sponges could be substituted.

The flexure of the base can also be varied by varying the widths (thicknesses) of the ribs, or by utilizing different rib patterns. In construction of the base, ribs of appropriately ½" in width and spaced approximately 1" apart have proven satisfactory. A center region 16 of about 4–5" on each side has also proved satisfactory in combination with ribs of the above-mentioned widths.

FIG. 4 shows diagrammatically a player sliding into the base. As the player p contacts the downturned and curved edge 22 of the base, the impact of the slide causes a further downturning. The impact absorbing base, however, will not be displaced from the retaining sleeve 11. The player's foot may move up and over to base, thereby eliminating the impact force of the slide entirely and leaving the base undeformed. If essentially linear pressure is applied during the slide, the contacted peripheral wall 15 and associated ribs are forced toward the center of the base and the linear pressure absorbed Injury is thereby avoided When the impact force of sliding has ended, the deformed portion of the base resiliently returns to its normal shape While particular embodiments of the invention have been shown and described, it will be obvious to one skilled in the art that certain modifications can be effected without departing from the spirit of the invention.

What is claimed is:

1. An impact absorbing base, comprising;

(a) top and peripheral walls defining the above ground portion of the base and also defining a hollow interior above the ground, wherein said top wall tapers downwardly from a central portion to the peripheral wall;

(b) a plurality of resiliently deformable ribs arranged in a chevroned pattern within the hollow interior so as to be laterally inwardly deformable under sliding impact forces, wherein each of said ribs has a vertical dimension such that the bottoms of said ribs and said peripheral wall define a bottom of the base which engages the ground;

(c) a post fixed to the base; and (d) means embedded in the ground for receiving the post and holding it in a predetermined position, whereby said ribs are laterally inwardly deformed as a result of sliding impact forces, so as to absorb such forces and minimize the risk of injury to a player, the resiliency of sad ribs retuning the same to their normal positions when the impact forces are terminated.

2. The impact absorbing base of claim 1, further including a solid region in the center of the hollow portion to which certain of the ribs are attached.

3. The impact absorbing base of claim 2, in which said ribs comprise a plurality of parallel ribs extending from a point on said peripheral wall to said solid region.

4. The impact absorbing base of claim 3, in which groups of ribs and said wall form at least one triangular configuration.

5. The impact absorbing base of claim 1, in which the ribs and top walls are integrally formed of molded rubber.

6. The impact absorbing base of claim 5, in which the rubber has a hardness of between 50 and 70, as measured by a Shore durometer.

7. The impact absorbing base of claim 1, further including an additional impact absorbing means inserted in the spaces between the ribs.

8. The impact absorbing base of claim 7, in which the additional impact absorbing means is a sponge.

9. The impact absorbing base of claim 7, in which the additional impact absorbing means is an expanded polymer.

10. The impact absorbing base of claim 7, in which the additional impact absorbing means is one of an open cell polymer and a closed cell polymer.

11. The impact absorbing base of claim 1, further includes treads located on an upper surface of the top wall.

12. The impact absorbing base of claim 1, in which the ribs are oriented in the hollow interior to respond to an impact by absorbing and dissipating its energy and urging the impacted edge of the base downward.

13. The impact absorbing base of claim 1, in which the thickness of the ribs is selected to provide a desired energy absorbing capacity of the base.

14. The energy absorbing base of claim 1, in which the material of which the base is made is selected to provide an energy absorbing capacity appropriate to the weight of a player.

15. The energy absorbing base of claim 1, in which the embedded means is a sleeve.

16. An impact absorbing base, comprising:

(a) top and peripheral walls defining the above ground portion of the base and also defining a hollow interior above the ground, said peripheral wall defining the corners of the base, said top tapering downwardly from a central portion thereof to said peripheral wall;

(b) a plurality of resiliently deformable ribs arranged within the hollow interior, certain of said ribs extending from said peripheral wall in locations between the corners of the base and being laterally spaced from each other so as to be laterally inwardly deformable under sliding impact forces, wherein each of said ribs has a vertical dimension such that the bottoms of said ribs and said peripheral wall define a bottom of the base which engages the ground;

(c) a post fixed to the base; and (d) means embedded in the ground for receiving the post and holding it in a predetermined position, whereby said ribs are laterally inwardly deformed as a result of sliding impact forces, so as to absorb such forces and minimize the risk of injury to a player, the resiliency of said ribs returning the same to their normal positions when the impact forces are terminated.

17. The impact absorbing base of claim 16, wherein certain of said resiliently deformable ribs are arranged in a chevroned pattern.

18. The impact absorbing base of claim 17, in which certain of said ribs extend from a point on said peripheral wall to a solid region in the center of the hollow portion, and in which other ribs extend from said peripheral wall to a point located intermediate said peripheral wall and said solid region, and interior ribs which extend perpendicularly from said other ribs.

* * * * *